US012252832B2

(12) United States Patent
Lee et al.

(10) Patent No.: US 12,252,832 B2
(45) Date of Patent: Mar. 18, 2025

(54) WASHING MACHINE AND SPIN-DRYING CONTROL METHOD FOR WASHING MACHINE

(71) Applicant: LG Electronics Inc., Seoul (KR)

(72) Inventors: Jongmin Lee, Seoul (KR); Byunghyun Moon, Seoul (KR); Sangwook Lee, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 17/774,376

(22) PCT Filed: Oct. 26, 2020

(86) PCT No.: PCT/KR2020/014628
§ 371 (c)(1),
(2) Date: May 4, 2022

(87) PCT Pub. No.: WO2021/091135
PCT Pub. Date: May 14, 2021

(65) Prior Publication Data

US 2022/0372684 A1 Nov. 24, 2022

(30) Foreign Application Priority Data

Nov. 4, 2019 (KR) ..... 10-2019-0139654
Nov. 4, 2019 (KR) ..... 10-2019-0139655

(51) Int. Cl.
*D06F 33/60* (2020.01)
*D06F 23/04* (2006.01)
(Continued)

(52) U.S. Cl.
CPC ..... *D06F 33/60* (2020.02); *D06F 23/04* (2013.01); *D06F 37/304* (2013.01);
(Continued)

(58) Field of Classification Search
None
See application file for complete search history.

(56) References Cited

U.S. PATENT DOCUMENTS

2004/0078902 A1* 4/2004 McGill ..... D06F 39/085 68/12.02
2008/0011024 A1* 1/2008 Won ..... D06F 39/14 68/212
2017/0302208 A1* 10/2017 Je ..... D06F 33/48

FOREIGN PATENT DOCUMENTS

JP 2016123532 7/2016
KR 19970027459 6/1997
(Continued)

OTHER PUBLICATIONS

International Search Report in International Appln. No. PCT/KR2020/014628, dated Feb. 9, 2021, 5 pages (with English translation).
(Continued)

*Primary Examiner* — Cristi J Tate-Sims
(74) *Attorney, Agent, or Firm* — Fish & Richardson P.C.

(57) ABSTRACT

A washing machine includes: an outer tub, an inner tub, a drain pump driven by an electric current to thereby drain water from the outer tub, a motor providing a rotational force to the inner tub, and a control unit controlling the drain pump and the motor. The control unit rotates the motor to increase a rotation speed of the inner tub to a preset first target speed during a sub spin-drying cycle to remove moisture from laundry in the inner tub, measure the current of the drain pump to measure an amount of water dehydrated from the laundry, measure, based on the current being increased and then decreased to or below a preset reference current, the rotation speed of the inner tub, and change a preset rotation time of the inner tub in a main spin-drying cycle according to the measured rotation speed of the inner tub.

13 Claims, 10 Drawing Sheets

(51) Int. Cl.

| | |
|---|---|
| ***D06F 37/30*** | (2020.01) |
| ***D06F 39/08*** | (2006.01) |
| *D06F 103/24* | (2020.01) |
| *D06F 103/48* | (2020.01) |
| *D06F 105/48* | (2020.01) |
| *D06F 105/56* | (2020.01) |

(52) U.S. Cl.
CPC ..... *D06F 39/085* (2013.01); *D06F 39/088* (2013.01); *D06F 2103/24* (2020.02); *D06F 2103/48* (2020.02); *D06F 2105/48* (2020.02); *D06F 2105/56* (2020.02)

(56) References Cited

FOREIGN PATENT DOCUMENTS

| | | |
|---|---|---|
| KR | 100125589 | 8/1998 |
| KR | 20090080819 | 7/2009 |
| KR | 10-2016-0061207 | 5/2016 |
| KR | 10-2019-0107652 | 9/2019 |
| KR | 20190122065 | 10/2019 |
| RU | 2566487 | 10/2015 |

OTHER PUBLICATIONS

Extended European Search Report in European Appln. No. 20886128.6, mailed on Jul. 21, 2023, 7 pages.
Search Report in Russian Appln. No. 2022114804, dated Nov. 11, 2022, 2 pages (English Translation).

* cited by examiner

WASHING MACHINE AND SPIN-DRYING CONTROL METHOD FOR WASHING MACHINE

CROSS-REFERENCE TO RELATED APPLICATIONS

This application is a National Stage application under 35 U.S.C. § 371 of International Application No. PCT/KR2020/014628, filed on Oct. 26, 2020, which claims the benefit of Korean Application Nos. 10-2019-0139654, filed on Nov. 4, 2019, and 10-2019-0139655, filed on Nov. 4, 2019. The disclosures of the prior applications are incorporated by reference in their entirety.

TECHNICAL FIELD

The present invention relates to a washing machine and a spin-drying control method for the same, and more particularly, to a washing machine and a spin-drying control method for the same detecting a current of a drain pump and controlling a spin-drying time based on an operation of the drain pump.

BACKGROUND

In general, a washing machine is a device that washes laundry using the emulsification effect of a detergent, the water flow action generated by the rotation of a washing tub or washing wings, the impacts applied by the washing wings, and the like, and performs a washing cycle, a rinsing cycle, and a spin-drying cycle to remove contamination from the laundry using the action of detergent and water.

In the spin-drying cycle, an amount of dehydration required varies depending on the drainage capacity of the laundry. If the amount of dehydration is insufficient, the laundry is wet and requires additional spin or drying, but if the amount of dehydration is excessive, winkling of clothes, time delay, and power consumption may occur. Therefore, it is important to set the appropriate spin-drying time.

Therefore, it is necessary to develop a technology capable of controlling an amount of dehydration by sensing the drainage ability of laundry. In addition, it is necessary to develop a control technology that improves the spin-drying efficiency by determining the dehydration state of laundry in real time.

A conventional washing method includes sensing the current of a drain pump during drainage, comparing it with a preset current value, and determining that there is no drainage and driving the drain pump when the sensed current is less than or equal to the preset current value.

However, if the drain pump is immediately stopped through current sensing in the spin-drying cycle as described above, the laundry water may accumulate in a lower portion of a tub, which may cause the problems of an overload in a motor, and terminating the spin-drying cycle even if the amount of dehydration is temporarily reduced.

In addition, a conventional washing machine may be implemented with a technology in which the rotation speed of a washing tub is increased step by step and a drainage is performed intermittently according to the rotation speed section of the washing tub during a spin-drying, and the drainage is performed while the washing tub rotates at a first set speed or less, the drainage is performed in a section in which the washing tub is accelerated from the first set speed to a second set speed, and the drainage is performed in a section in which the washing tub rotates at the second set speed or higher.

However, if the rotation speed is increased in stages and the water is drained intermittently according to the speed section, there is a problem that excessive dehydration may occur, causing wrinkles, time delay, and power wastage.

SUMMARY

The present invention is directed to a washing machine and spin-drying control method for the washing machine for determining a drainage capacity of laundry and setting an amount of dehydration corresponding thereto.

The present invention is also directed to a washing machine and a spin-drying control method of the same for controlling a spin-drying time by determining an amount of dehydration.

According to one aspect of the subject matter described in this application, a washing machine can include an outer tub configured to receive water, an inner tub rotatably disposed with respect to a vertical axis of the outer tub, defining an opening at a lower portion, and in fluid communication with the outer tub, a drain pump configured to be driven by an electric current to thereby drain the water from the outer tub, a motor configured to provide a rotational force to the inner tub, and a control unit including a processor and configured to control the drain pump and the motor to perform a spin-drying cycle including a sub spin-drying cycle and a main spin-drying cycle. The control unit can be configured to rotate the motor to increase a rotation speed of the inner tub to a preset first target speed during the sub spin-drying cycle to remove moisture from laundry received in the inner tub, measure the current of the drain pump to measure an amount of water dehydrated from the laundry while the inner tub is rotated, measure, based on the current of the drain pump being increased and then decreased to or below a preset reference current, the rotation speed of the inner tub, and change a preset rotation time of the inner tub in the main spin-drying cycle according to the measured rotation speed of the inner tub.

Implementations according to this aspect can include one or more of the following features. For example, the control unit can be configured to, based on the current of the drain pump exceeding the reference current in a state in which the rotation speed of the inner tub is increased to the first target speed, increase the preset rotation time of the inner tub in the main spin-drying cycle during the sub spin-drying cycle.

In some implementations, the control unit can be configured to, based on the measured rotation speed of the inner tub being less than a preset first reference speed, shorten the preset rotation time of the inner tub in the main spin-drying cycle during the sub spin-drying cycle. In some implementations, the control unit can be configured to, based on the measured rotation speed of the inner tub being less than a preset first reference speed, decrease the rotation speed of the inner tub in the main spin-drying cycle during the sub spin-drying cycle.

In some examples, during the main spin-drying cycle, the control unit can be configured to rotate the motor to increase the rotation speed of the inner tub to a second target speed, measure the current of the drain pump while the inner tub is rotated at the second target speed, measure, based on the current of the drain pump being increased and then decreased to or below the reference current, the rotation speed of the inner tub, and extend, based on the measured rotation speed of the inner tub exceeding a preset second reference speed, the changed rotation time of the inner tub in the main spin-drying cycle. In some examples, during the main spin-drying cycle, the control unit can be configured to rotate the motor to increase the rotation speed of the inner tub to a second target speed, measure the current of the drain pump while the inner tub is rotated at the second target speed, measure, based on the current of the drain pump being increased and then decreased to or below the reference current, the rotation speed of the inner tub, and shorten, based on the measured rotation speed of the inner tub being less than a preset third reference speed, the changed rotation time of the inner tub in the main spin-drying cycle.

In some implementations, the inner tub can include a nozzle configured to spray water by centrifugal force during rotation of the inner tub, and the control unit can be configured to perform a jet rinsing cycle in which the water is sprayed onto the laundry through the nozzle while the inner tub is rotated at a predetermined speed between the sub spin-drying cycle and the main spin-drying cycle. In some examples, the control unit can be configured to measure the current of the drain pump during the jet rinsing cycle, measure a jet rinsing drainage time from the jet rinsing cycle is started to the current of the drain pump is increased to or above the reference current, and extend, based on the jet rinsing drainage time exceeding a preset first reference time, the changed rotation time of the inner tub in the main spin-drying cycle.

In some examples, the control unit can be configured to measure the current of the drain pump during the jet rinsing cycle, measure a jet rinsing drainage time from the jet rinsing cycle is started to the current of the drain pump is increased to or above the reference current, and shorten, based on the jet rinsing drainage time being less than a preset second reference time, the changed rotation time of the inner tub in the main spin-drying cycle.

According to another aspect of the subject matter described in this application, a washing machine can include an outer tub configured to receive water, an inner tub rotatably disposed with respect to a vertical axis of the outer tub, defining an opening at a lower portion, and in fluid communication with the outer tub, a drain pump configured to be driven by an electric current to thereby drain the water from the outer tub, a motor configured to provide a rotational force to the inner tub, and a control unit including a processor and configured to control the drain pump and the motor to perform a spin-drying cycle including a sub spin-drying cycle and a main spin-drying cycle. The control unit can be configured to control the motor to drive the drain pump while rotating the inner tub during the main spin-drying cycle, stop, based on a rotation speed of the inner tub being increased to a preset target speed, the drain pump for a preset stop time, measure a value of the current of the drain pump by driving the drain pump after the stop time has elapsed, and determine whether a spin-drying time is changed based on the current value of the drain pump and a preset reference current value.

Implementations according to this aspect can include one or more of the following features. For example, the control unit can be configured to, based on the current value of the drain pump exceeding a preset reference current value, determine whether to change the spin-drying time based on a time elapsed since the inner tub starts to rotate and a reference time.

In some implementations, the control unit can be configured to, based on the time elapsed since the inner tub starts to rotate exceeding the reference time, increase the spin-drying time. In some implementations, the control unit can be configured to, based on the time elapsed since the inner tub starts to rotate exceeding the reference time, increase a rotation speed of the inner tub.

In some examples, the control unit can be configured to, based on the time elapsed since the inner tub starts to rotate exceeding the reference time, shorten a time for stopping the driving of the drain pump. In some implementations, the control unit can be configured to, based on the current value of the drain pump being less than the reference current value, stop the drain pump for the stop time.

In some examples, the control unit can be configured to, based on the stop time elapses after the driving of the drain pump being stopped again, drive the drain pump, measure the current value of the drain pump again, and determine whether to terminate the spin-drying cycle based on the remeasured current value of the drain pump and the preset reference current value. In some examples, the control unit can be configured to, based on the remeasured current value of the drain pump exceeding the reference current value, change the spin-drying time based on the time elapsed since the inner tub starts to rotate and a reference time.

In some examples, the control unit can be configured to, based on the remeasured current value of the drain pump being less than or equal to the reference current value, terminate the spin-drying cycle. In some implementations, the control unit can be configured to increase a rotation speed of the inner tub to a sub spin-drying target speed during the sub spin-drying cycle, measure the current of the drain pump during the rotation of the inner tub, determine, based on the current of the drain pump being increased and then decreased to or below a preset detection current, an amount of laundry by measuring the rotation speed of the inner tub, and perform the main spin-drying cycle after setting the stop time in proportion to the amount of laundry.

According to another aspect of the subject matter described in this application, a method for controlling a spin-drying of a washing machine including a sub spin-drying cycle and a main spin-drying cycle can include a sub spin-drying drainage amount measuring step, performed in the sub spin-drying cycle, including removing water from laundry while increasing a rotation speed of an inner tub of the washing machine to a preset first target speed, and determining a drainage amount by measuring a current of a drain pump that discharges moisture dehydrated from the laundry, a sub spin-drying drainage speed measuring step including measuring, based on the current of the drain pump being increased and then decreased to or below a preset reference current, the rotation speed of the inner tub, and a main spin-drying time setting step including setting a rotation time of the inner tub in the main spin-drying cycle based on the measured rotation speed of the inner tub.

Implementations according to this aspect can include one or more of the following features. For example, the method can further include a main spin-drying drainage amount measuring step, performed in the main spin-drying cycle, including measuring the current of the drain pump while increasing the rotation speed of the inner tub to a preset second target speed, a main spin-drying drainage speed measuring step including measuring, based on the current of the drain pump being increased and then decreased to or below the reference current, the rotation speed of the inner tub, and a main spin-drying time adjusting step including adjusting a rotation time of the inner tub set in the main spin-drying time setting step based on the measured rotation speed of the inner tub.

In some implementations, the method can further include a jet rinsing cycle step including spraying water to the laundry while rotating the inner tub at a predetermined rotation speed after the sub spin-drying cycle. In some examples, the jet rinsing cycle step can include a jet rinsing drainage amount measuring step including spraying the water to the laundry while rotating the inner tub at the predetermined rotation speed, and measuring the current of the drain pump, a jet rinsing drainage time measuring step including measuring a time from the spray of water is started to the current of the drain pump is increased to or above the reference current, and a main spin-drying time correcting step including correcting the rotation time of the inner tub set in the main spin-drying time setting step based on the time measured in the jet rinsing drainage time measuring step.

According to another aspect of the subject matter described in this application, a method for controlling a spin-drying of a washing machine including a drain pump can include a spin-drying starting step, performed in a main spin-drying cycle, including driving the drain pump while rotating an inner tub of the washing machine, and dehydrating laundry while increasing a rotation speed of the inner tub to a preset target speed, a drain stopping step including stopping, based on the rotation speed of the inner tub reaching a preset target speed in the spin-drying starting step, the drain pump for a preset stop time, and a drainage amount determining step, performed after the drain stopping step, including driving the drain pump, and measuring a value of electric current of the drain pump to determine whether the current value of the drain pump exceeds a preset reference current value.

Implementations according to this aspect can include one or more of the following features. For example, the method can further include a spin-drying time adjusting step including changing, when the current value of the drain pump measured in the drainage amount determining step exceeding a present reference current value, a spin-drying time based on a time elapsed since the inner tub starts to rotate and a preset reference time.

In some implementations, the method can further include a re-stopping step including stopping, based on the current value of the drain pump measured in the drainage amount determining step being less than or equal to the reference current value, the drain pump for the stop time. In some examples, the method can further include a spin-drying termination determining step, performed after the re-stopping step, including driving the drain pump, measuring the current value of the drain pump again, and determining whether to terminate the main spin-drying cycle based on the remeasured current value of the drain pump and the reference current value. In some implementations, the method can further include a stop time setting step, performed in a sub spin-drying cycle step, including determining, based on the current of the drain pump being increased and then decreased to or below a preset detection current, a moisture content of the laundry based on the rotation speed of the inner tub, and setting the stop time of the drain pump in the drain stopping step in proportion to the moisture content.

As described above, the washing machine and the spin-drying control method of the same can improve energy and washing time efficiency by identifying the draining capacity of laundry and setting an amount of dehydration corresponding thereto.

In addition, the washing machine and the spin-drying control method of the same can provide a constant degree of spin-drying by identifying the draining capacity of laundry and setting the time of spin-drying cycle and the rotation speed of the spin-drying corresponding to thereto.

In addition, the washing machine and the spin-drying control method of the same can reduce wrinkling of laundry due to excessive dehydration.

DETAILED DESCRIPTION

Figure 1:
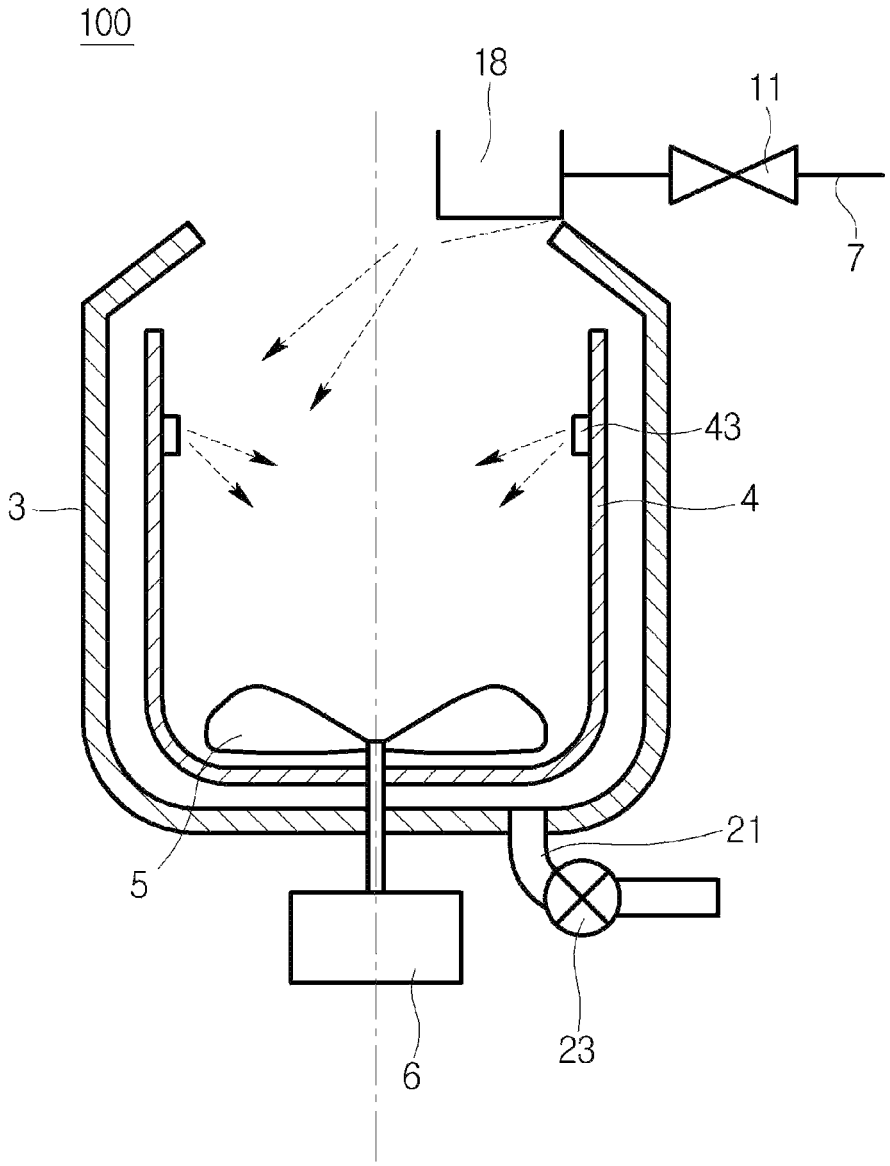
FIG. 1 is a diagram illustrating an exemplary washing machine.
Figure 2:
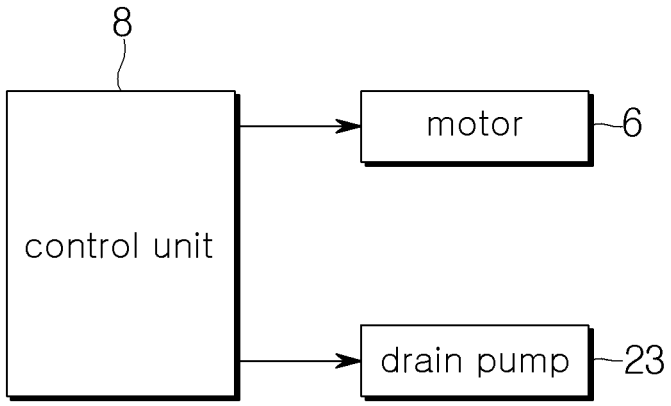
FIG. 2 is a diagram illustrating a control relationship between components included in the exemplary washing machine.

FIG. 1 is a diagram illustrating an exemplary washing machine, and FIG. 2 is a diagram illustrating a control relationship between components included in the exemplary washing machine.

Referring to FIGS. 1 and 2, a washing machine 100 can include an outer tub 3 containing water, and an inner tub 4 that accommodates laundry and is rotatably disposed in the outer tub 3, and a pulsator 5 that is rotatably disposed at a lower portion of the inner tub 4.

The outer tub 3 is disposed in a casing defining the exterior of the washing machine 100, and can be suspended within the casing by a suspension so that the vibration caused by the rotation of the inner tub 4 can be buffered.

The outer tub 3 rotates about an axis perpendicular to the ground, and the outer tub 3 can have a tubular shape with an opening defined at an upper side so that laundry can be received by the inner tub 4 from the upper side.

The inner tub 4 can be rotatably disposed in the outer tub 3, and an opening providing fluid communication to the outer tub 3 can be defined at a lower portion of the inner tub 4.

A plurality of through holes providing fluid communication to the outer tub 3 is defined at a side surface (on an inner circumferential surface) of the inner tub 4 to allow moisture to be introduced and emitted.

In addition, a nozzle 43 configured to inject water into the inner tub 4 by using centrifugal force according to the rotation of the inner tub 4 can be provided.

A plurality of through holes can be defined in the pulsator 5, and the water introduced from the outer tub 3 through the opening of the inner tub 4 can move upward through the through holes defined at the pulsator 5 to move into the inner tub 4.

A motor 6 can provide a rotational force to the inner tub 4 or the pulsator 5. The rotational shaft of the motor 6 can be coupled to the pulsator 5 to provide the rotational force, and the rotational shaft of the motor 6 can provide the rotational force to the inner tub 4 through clutch engagement. Therefore, in the state in which the clutch is engaged, the rotation shaft rotates integrally with the inner tub 4 and the pulsator 5. In some implementations, when the clutch is released, the inner tub 4, in a stopped state, can rotate only the pulsator 5.

The motor 6 can be capable of speed control. For example, the motor 6 can be a brushless DC motor (BLDC), but is not necessarily limited thereto. A technology for controlling the rotation speed of the inner tub 4 or the pulsator 5 using a speed-controllable motor such as BLDC is already well known in the washing machine technology field, and a detailed description thereof will be omitted.

The washing machine 100 can include a water supply unit for supplying water into the outer tub 3 and a drain unit for draining water from the outer tub 3.

The water supply unit can include a water supply valve 71 for controlling a water supply pipe 7 connected to a water supply source.

A drawer 18 can be provided on the water supply pipe 7, and when the water supply valve 71 is opened, the water supplied through the water supply pipe 7 passes through the drawer 18, and then can be supplied into the outer tub 3 or the inner tub 4.

In some implementations, the water supply unit can be provided with a water supply nozzle that directly injects water into the inner tub 4 without passing through the drawer 18.

The drain unit can include a drain pump 23 provided on a drain pipe 21 for discharging the water in the outer tub 3 to the outside. The drain pump 23 can increase a drain current value as an amount of drainage increases.

In some implementations, the washing machine 100 can include a control panel that displays an input unit that selects or receives various settings (e.g., course selection, time input, etc.) from a user, and a display unit that displays an operation state (e.g., course progress status, remaining time, etc.) of the washing machine 100.

A control unit 8 can control the operations of components included in the washing machine 100 and can include a microprocessor. Hereinafter, in describing the control method of the washing machine, it will be understood that the components are controlled by the control unit 8 unless otherwise specified.

The control unit 8 can perform a washing cycle, a rinsing cycle, and a spin-drying cycle.

In some implementations, the spin-drying cycle can include a sub spin-drying cycle and a main spin-drying cycle. In addition, the spin-drying cycle can further include a jet rinsing cycle in which water is sprayed onto the laundry through the nozzle 43 using the centrifugal force of the inner tub 4 while rotating the inner tub 4 at a predetermined speed.

In some implementations, the control unit 8 can control the drain pump 23 and the motor 6. For example, the control unit 8 can control the operation of the drain pump 23 and measure the current of the drain pump 23. In some implementations, the control unit 8 can measure and control the rotation speed of the motor 6, thereby measuring and controlling the rotation speed of the inner tub 4. In addition, the control unit 8 can spray water through the nozzle 43. In some implementations, the control unit 8 can measure time.

Hereinafter, a method for controlling the spin-drying of the washing machine 100 will be described.

Figure 3:
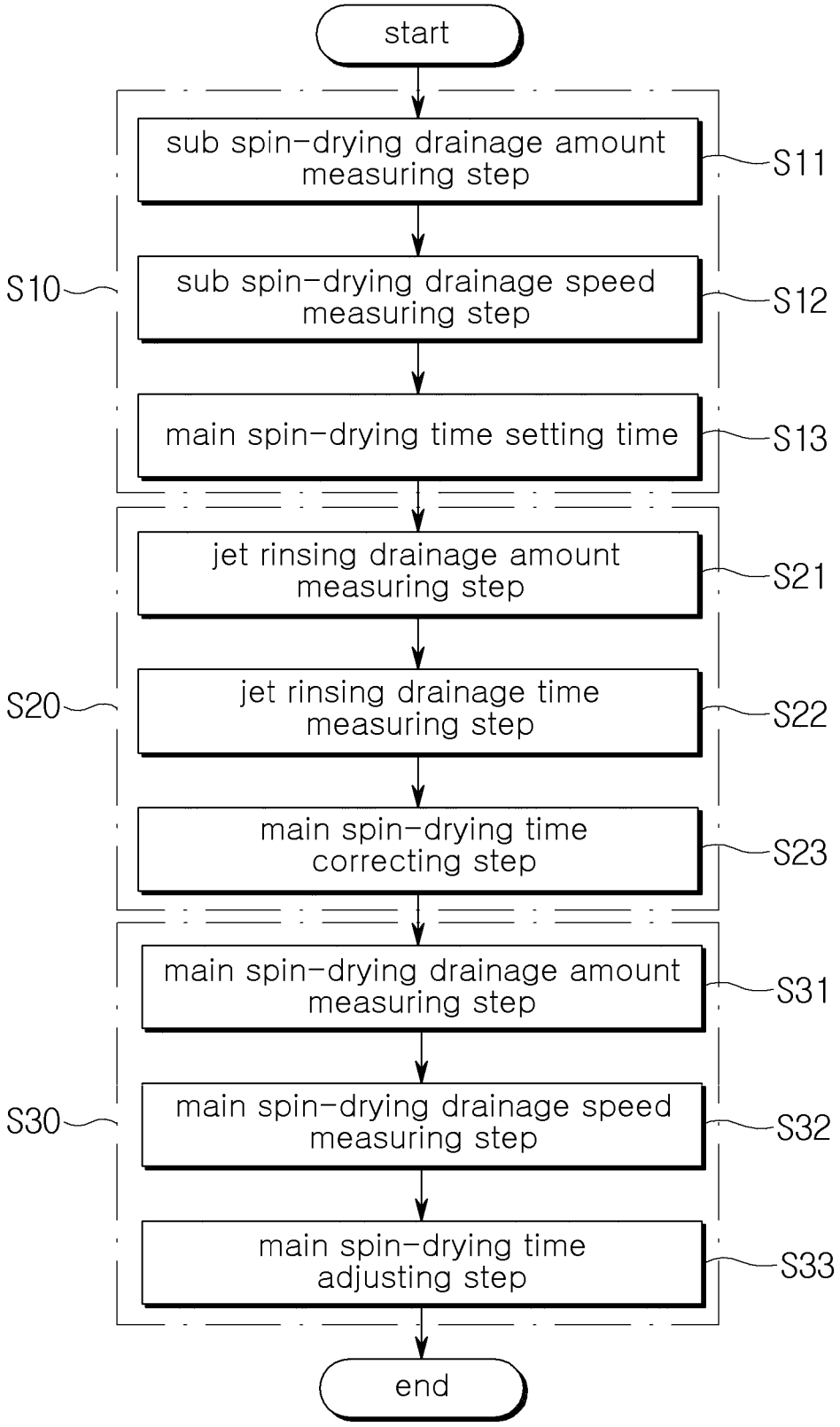
FIG. 3 is a flowchart illustrating an exemplary spin-drying control method of a washing machine.
Figure 4:
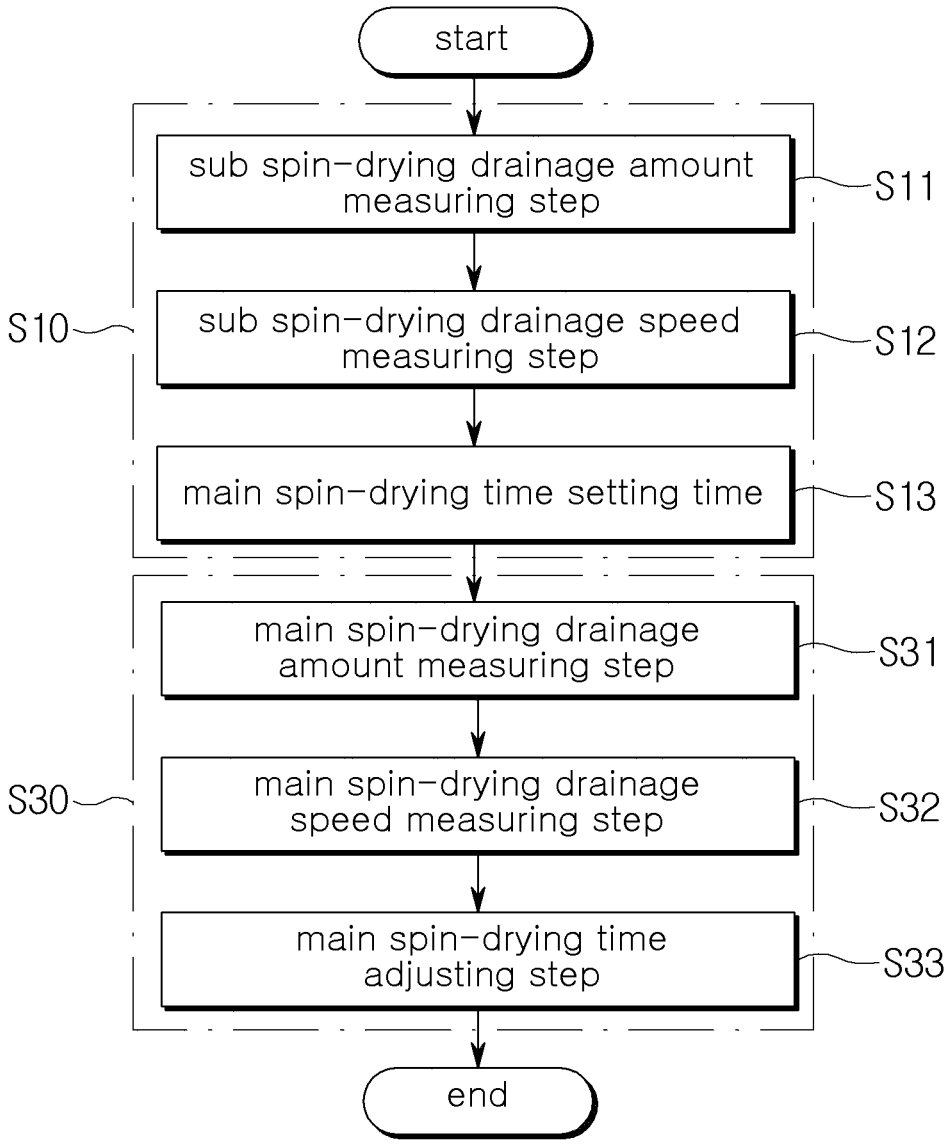
FIG. 4 is a flowchart illustrating a state in which a jet rinsing cycle is not performed in the exemplary spin-drying control method of a washing machine.
Figure 5:
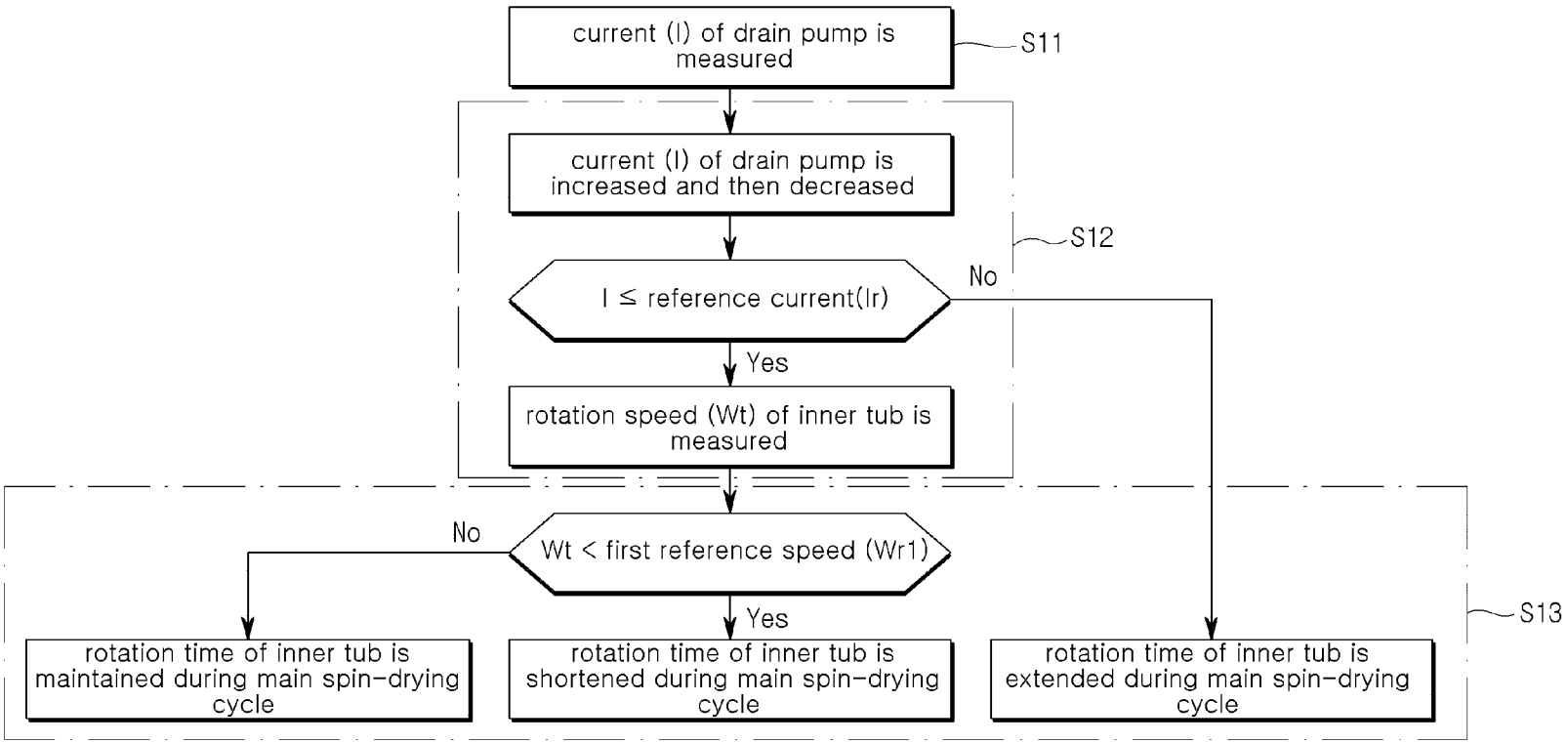
FIG. 5 is a diagram describing a control step in a sub spin-drying cycle in an exemplary spin-drying control method of a washing machine.
Figure 6:
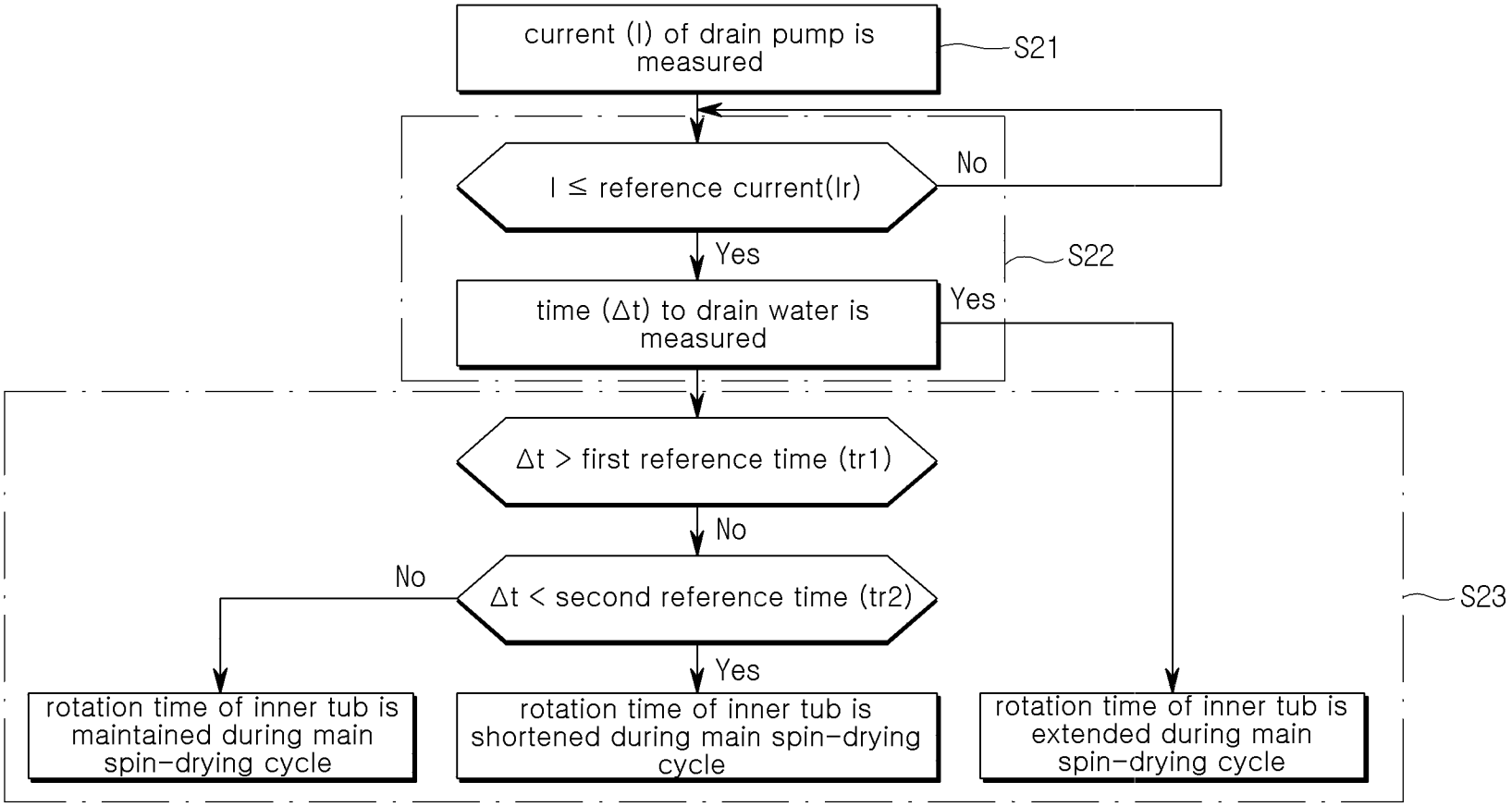
FIG. 6 is a diagram describing a control step in a jet rinsing cycle in an exemplary spin-drying control method of a washing machine.
Figure 7:
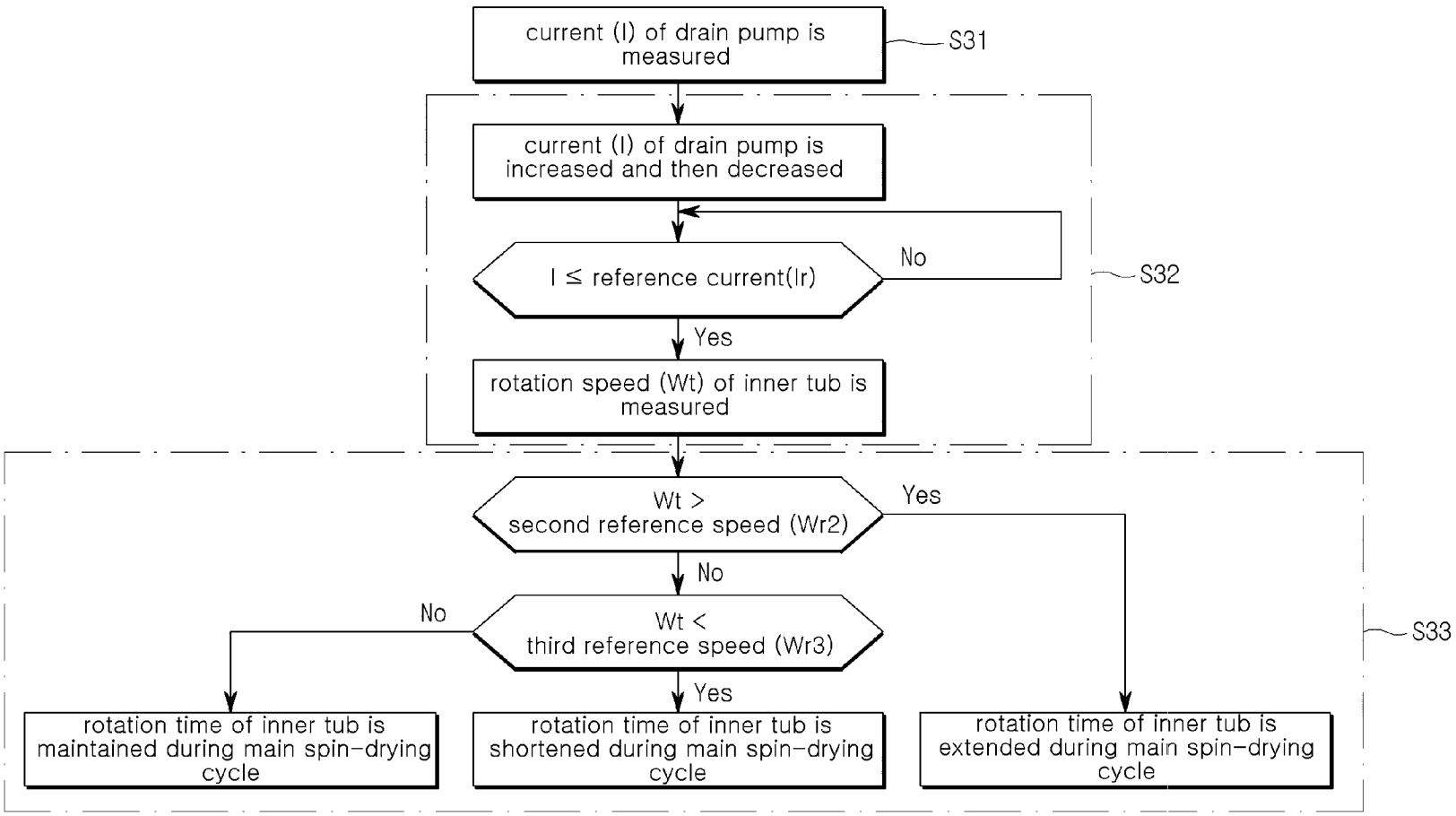
FIG. 7 is a diagram describing a control step in a main spin-drying cycle in an exemplary spin-drying control method of a washing machine.
Figure 8:
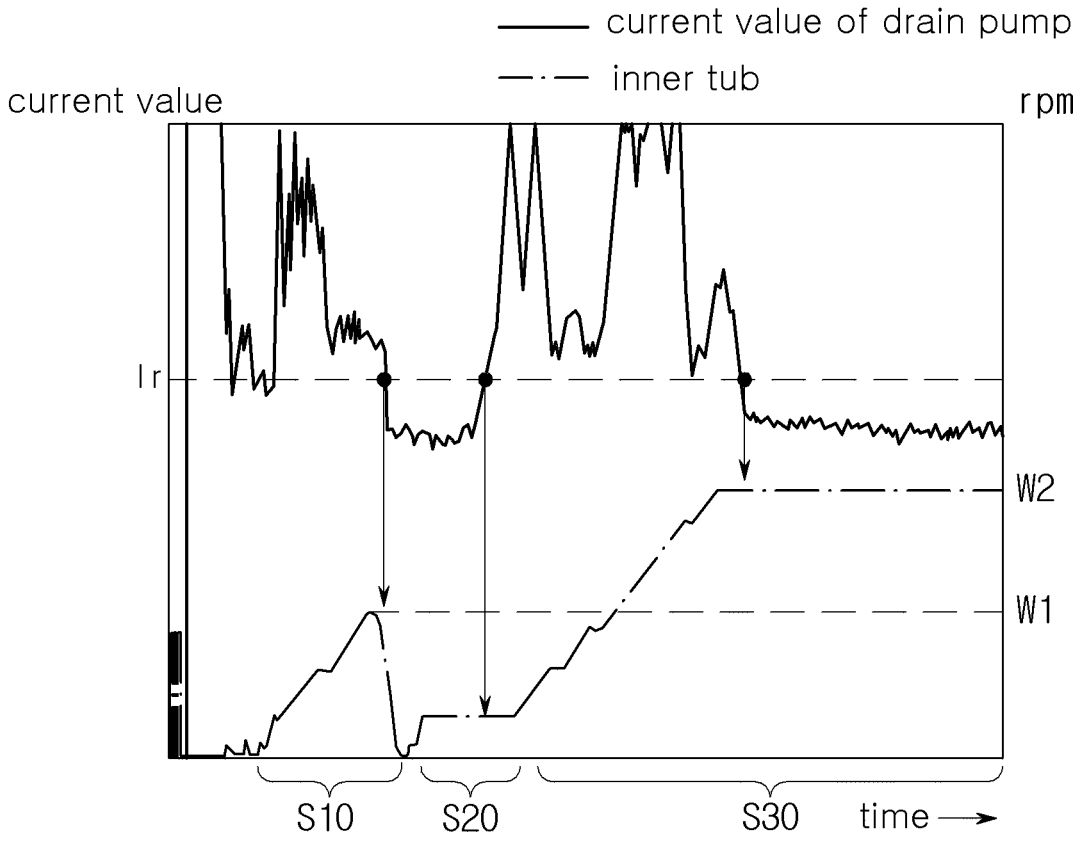
FIG. 8 is a graph illustrating a change in a rotation speed of an inner tub according to a spin-drying cycle in an exemplary washing machine.

FIG. 3 is a flowchart illustrating an exemplary spin-drying control method of a washing machine, FIG. 4 is a flowchart illustrating an exemplary spin-drying control method of a washing machine in which a jet rinsing cycle is not performed, FIG. 5 is a diagram describing a control step in a sub spin-drying cycle in a spin-drying control method of an exemplary washing machine, FIG. 6 is a diagram describing a control step in a jet rinsing cycle in a spin-drying control method of an exemplary washing machine, FIG. 7 is a diagram describing a control step in a main spin-drying cycle in a spin-drying control method of an exemplary washing machine, and FIG. 8 is a graph illustrating a change in a rotation speed of an inner tub according to a spin-drying cycle in an exemplary washing machine according.

An exemplary spin-drying control method of a washing machine will be described with reference to FIGS. 3 to 8.

An exemplary spin-drying control method of a washing machine can include a sub spin-drying cycle step (S10), a jet rinsing cycle step (S20), and a main spin-drying cycle step (S30).

In some implementations, a first target speed (W1), a second target speed (W2), a first reference speed (Wr1), a second reference speed (Wr2), a third reference speed (Wr3), a reference current (Ir), a first reference time (tr1), and a second reference time (tr2) can be preset in the control unit 8.

In some implementations, the first reference speed (Wr1) can be set to be less than the first target speed (W1) (Wr1<W1).

In some implementations, the control unit 8 may or may not selectively perform the jet rinsing cycle step (S20).

The sub spin-drying cycle step (S10) can refer to a cycle in which after the rinsing cycle is terminated and all the water used in the rinsing cycle is drained, the moisture from the laundry is removed, but the rotation speed is decreased compared to the rotation speed in the main spin-drying cycle step (S30) to rotate the inner tub 4 in order to alleviate wrinkling of laundry. For example, if the maximum rotation speed of the inner tub 4 can be increased to 800 rpm or more and 900 rpm or less in the main spin-drying cycle step (S30), the maximum rotation speed of the inner tub 4 can be increased to 400 rpm or more and 500 rpm or less in the sub spin-drying cycle step (S10).

The sub spin-drying cycle step (S10) can include a sub spin-drying drainage amount measuring step (S11), a sub spin-drying drainage speed measuring step (S12), and a main spin-drying time setting step (S13).

In the sub spin-drying drainage amount measuring step (S11), the control unit 8 can rotate the motor 6 to increase the rotation speed (W) of the inner tub 4 up to a preset first target speed (W1) to remove moisture from the laundry, and measure the current (I) of the drain pump 23 to determine the drainage amount. For example, the control unit 8 can measure a change in the current (I) of the drain pump 23 and a change in the drainage amount while increasing the rotation speed (W) of the inner tub 4 to 450 rpm.

If the rotation speed (W) of the inner tub 4 is gradually increased, the moisture of laundry is discharged to the outer tub 3 through the through hole defined in the inner tub 4 by centrifugal force, and the water in the outer tub 3 may be discharged to the outside by the operation of the drain pump 23 after flowing into the drain pipe 21. In some implementations, if the drain pump 23 operates, the current (I) required for the operation increases in proportion to the increase in the drainage amount. Therefore, the control unit 8 can measure the current (I) of the drain pump 23 to determine the drainage amount during the sub spin-drying cycle.

In the sub spin-drying drainage speed measuring step (S12), the control unit can measure the rotation speed (Wt) of the inner tub 4 when the current (I) of the drain pump 23 increases and then decreases to or below a preset reference current (Ir) (I≤Ir).

When the rotation speed (W) of the inner tub 4 is gradually increased in the sub spin-drying cycle step (S10), the current (I) of the drain pump 23 increases rapidly and then decreases and maintains a predetermined current (this is referred to as 'intermediate current'), and then decreases once more and maintains a predetermined current range (this can be referred to as 'minimum current'). In some implementations, maintaining the minimum current range may refer that sufficient drainage has already been made.

Accordingly, the point in time when the reference current (Ir) is set higher than the minimum current (lower than the intermediate current), and the current (I) of the drain pump 23 increases and then decreases to or below the reference current (Ir) (I≤Ir) can be seen as the point in time when sufficient drainage is made.

In the main spin-drying time setting step (S13), the control unit 8 can set (change) the rotation time (T) of the inner tub 4 in the main spin-drying cycle based on the rotation speed (Wt) of the inner tub 4 measured in the sub spin-drying drainage speed measuring step (S12).

The rotation time (T) of the inner tub 4 in the main spin-drying cycle can be preset (Ti) in the control unit 8. In some implementations, the rotation time (T) of the inner tub 4 may be directly input by the user through an input unit, and the control unit 8 can set the rotation time (T) of the inner tub 4 by detecting the amount (weight) of laundry.

However, when the user inputs the expected time (Ti) as the rotation time of the inner tub 4 (T=Ti), or the control unit 8 sets the rotation time of the inner tub 4 as the time (Ti) calculated simply through the amount (mass) of the laundry (T=Ti), it does not reflect how much water the laundry contains during the washing and rinsing cycles and the drainage properties of the laundry. Accordingly, there may be problems in that the laundry is wet due to insufficient dehydration, or the laundry is wrinkled due to excessive dehydration.

In order to solve this problem, in some implementations, when, in a state (W=W1) in which the rotation speed (W) of the inner tub 4 is increased to the first target speed (W1), the current (I) of the drain pump 23 exceeds the reference current (Ir) (I>Ir), the control unit 8 may no longer increase the rotation speed (W) of the inner tub 4, so that it is determined that the laundry retains a lot of moisture and, the rotation time may be set as the extension time (Te) (T=Te) by extending the preset rotation time (Ti) of the inner tub 4 in the main spin-drying cycle step. In some implementations, the extension time (Te) can be set to be greater than the preset rotation time (Ti) of the inner tub 4 (Te>Ti).

In some implementations, when the rotation speed (Wt) of the inner tub 4 measured in the sub spin-drying drainage speed measuring step (S12) is less than the preset first reference speed (Wr1) (Wt<Wr1), the control unit 8 can determine that the laundry has a little moisture, and shorten the preset rotation time (Ti) of the inner tub in the main spin-drying cycle. For example, when the rotation speed (Wt) of the inner tub 4 measured in the sub spin-drying drainage speed measuring step (S12) is less than the preset first reference speed (Wr1) (Wt<Wr1), the control unit 8 can shorten the preset rotation time (Ti) of the inner tub and set it as the shortened time (Ts). In some implementations, the shortened time (Ts) can be set to be smaller (Ts<Ti) than the preset rotation time (Ti) of the inner tub 4 in the main spin-drying cycle step.

In some implementations, when the rotation speed (Wt) of the inner tub 4 measured in the sub spin-drying drainage speed measuring step (S12) is greater than or equal to the preset first reference speed (Wr1) and less than or equal to the first target speed (W1) (Wr1≤Wt≤W1), the preset rotation time (Ti) of the inner tub can be maintained (T=Ti).

In some implementations, when the rotation speed (Wt) of the inner tub 4 measured in the sub spin-drying drainage speed measuring step (S12) is less than the preset first reference speed (Wr1) (Wt<Wr1), the preset maximum rotation speed of the inner tub 4 can be reduced in the main spin-drying cycle (which may mean a second target speed to be described later).

The jet rinsing cycle step (S20) can refer to a cycle in which the laundry is rinsed by spraying water to the laundry through the nozzle 43 while the inner tub 4 is rotated at a predetermined rotation speed after the sub spin-drying cycle step (S10).

The jet rinsing cycle step (S20) can include a jet rinsing drainage amount measuring step (S21), a jet rinsing drainage time measuring step (S22), and a main spin-drying time correcting step (S23).

In the jet rinsing drainage amount measuring step (S21), the inner tub 4 can maintained at a predetermined rotation speed (Wj) and rotated while water is sprayed onto the laundry using the centrifugal force of the inner tub 4, and the current (I) of the drain pump 23 can be measured. For example, in the jet rinsing drainage amount measuring step (S21), while maintaining the rotation speed of the inner tub 4 at 90 rpm or more and 110 rpm or less, water is sprayed on the laundry, and the current (I) of the drain pump 23 can be measured.

In the jet rinsing drainage time measuring step (S22), the time (Δt) from the point in time when water is started to be sprayed in the jet rinsing drainage amount measuring step (S21) to the point in time when the current (I) of the drain pump 23 increases to the reference current (Ir) or greater (Ir≥Ir) can be measured.

In the jet rinsing drainage time measuring step (S22), since the inner tub 4 rotates while maintaining a predetermined rotation speed range and at the same time, water is supplied to the laundry, the drainage property (drainage capacity) of the laundry through the time (Δt) from the point in time when water is supplied to the laundry to the point in time when the supplied water is drained again can be determined.

In the main spin-drying time correcting step (S23), the rotation time (T) of the inner tub set in the main spin-drying time setting step (S13) can be corrected (T1) based on the time (Δt) measured in the jet rinsing drainage time measuring step (S22).

In some implementations, the first reference time (tr1) and the second reference time (tr2) can be set in the control unit 8, and the first reference time (tr1) can be set to be greater than the second reference time (tr2) (tr1>tr2).

In some implementations, when the time (Δt) measured in the jet rinsing drainage time measuring step (S22) exceeds the first reference time (tr1) (Δt>tr1), it is determined that the drainage capacity of the laundry is low, and the rotation time (T) of the inner tub set in the main spin-drying time setting step (S13) can be further extended. For example, as the value obtained by subtracting the first reference time (tr1) from the time Δt measured in the jet rinsing drainage time measuring step (S22) increases, the rotation time (T) of the inner tub set in the main spin-drying time setting step (S13) can be corrected to increase in proportion to the obtained value. In addition, an additional time (te1) is given by setting a section for a value obtained by subtracting the first reference time (tr1) from the time (Δt) measured in the jet rinsing drainage time measuring step (S22), and this may be added to the rotation time (T) of the inner tub set in the main spin-drying time setting step (S13) (T1=T+te1).

In some implementations, when the time (Δt) measured in the jet rinsing drainage time measuring step (S22) is less than the second reference time (tr2) (Δt<tr2), it is determined that the laundry has a high drainage capacity, and the rotation time (T) of the inner tub set in the main spin-drying time setting step (S13) can be shorten. For example, as the value obtained by subtracting the time (Δt) measured in the jet rinsing drainage time measuring step (S22) from the second reference time (tr2) increases, the rotation time (T) of the inner tub measured in the main spin-drying time setting step (S13) can be corrected to decrease in proportion to the obtained value. In addition, a shortened time (ts1) is given by setting a section for a value obtained by subtracting the time (Δt) measured in the jet rinsing drainage time measuring step (S22) from the second reference time (tr2), and this can be subtracted from the rotation time (T) of the inner tub set in the main spin-drying time setting step (S13) (T1=T−ts1).

In some implementations, when the time (Δt) measured in the jet rinsing drainage time measuring step (S22) is equal to or less than the first reference time and greater than or equal to the second reference time (tr2) (tr2≤Δt≤tr1), the rotation time of the inner tub set in the main spin-drying time setting step (S13) can be maintained (T1=T).

The main spin-drying cycle step (S30) can refer to a cycle in which the inner tub 4 is rotated in order to remove moisture from the laundry after the jet rinsing cycle step (S20) (if the jet rinsing cycle step (S20) is not performed, after the sub spin-drying cycle step (S10)).

The main spin-drying cycle step (S30) can include a main spin-drying drainage amount measuring step (S31), a main spin-drying drainage speed measuring step (S32), and a main spin-drying time adjusting step (S33).

In the main spin-drying drainage amount measuring step (S31), the control unit 8 may measure the current (I) of the drain pump 23 while increasing the rotation speed (W) of the inner tub 4 to a preset second target speed (W2). For example, the control unit 8 may measure the change in the current (I) of the drain pump 23 and determine the change in the drainage amount while increasing the rotation speed (W) of the inner tub 4 to 840 rpm.

In the main spin-drying drainage speed measuring step (S32), the control unit 8 can measure the rotation speed of the inner tub when the current of the drain pump increases and then decreases to or below the reference current.

Referring to FIG. 4, when the rotation speed (W) of the inner tub 4 gradually increases in the main spin-drying cycle step (S30), it can be seen that the current (I) of the drain pump 23 rapidly increases and then decreases, and is maintained to a minimum. In some implementations, maintaining the minimum current range can refer that sufficient drainage has already been made.

Accordingly, it can be seen that the point in time when the current (I) of the drain pump 23 increases and then decreases to or below the reference current (Ir) (I≤Ir) is the point in time when sufficient drainage is achieved.

Hereinafter, a case in which the jet rinsing cycle step (S20) is not performed and a case in which the jet rinsing cycle step (S20) is performed will be separately described.

First, in the case where the jet rinsing cycle step (S20) is not performed, the control unit 8 can control (T2) the rotation time (T) of the inner tub 4 measured in the main spin-drying time setting step (S13) based on the rotation speed (Wt) of the inner tub 4 set in the main spin-drying drainage speed setting step (S32), in the main spin-drying time adjusting step (S33).

In some implementations, when the rotation speed (Wt) of the inner tub 4 measured in the main spin-drying drainage speed measuring step (S32) exceeds a preset second reference speed (Wr2) (Wt>Wr2), the control unit 8 can extend the rotation time (T) of the inner tub set in the main spin-drying time setting step (S13) (T2>T). For example, based on the value obtained by subtracting the preset second reference speed (Wr2) from the rotation speed (Wt) of the inner tub 4 measured in the main spin-drying drainage speed measuring step (S32), the rotation time (T) of the inner tub set in the main spin-drying time setting step (S13) can be corrected to increase in proportion to the obtained value. In addition, an additional time (te2) is given by setting a section for a value obtained by subtracting the second reference speed (Wr2) from the rotation speed (Wt) of the inner tub 4 measured in the main spin-drying drainage speed measuring step (S32), and this can be added to the rotation time (T) of the inner tub set in the main spin-drying time setting step (S13) (T2=T+te2).

In some implementations, when the rotation speed (Wt) of the inner tub 4 measured in the main spin-drying drainage speed measuring step (S32) is less than a preset third reference speed (Wr3) (Wt<Wr3), the control unit 8 can shorten the rotation time (T) of the inner tub set in the main spin-drying time setting step (S13) (T2<T). For example, based on the value obtained by subtracting the rotation speed (Wt) of the inner tub 4 measured in the main spin-drying drainage speed measuring step (S32) from the third reference speed (Wr3), the rotation time (T) of the inner tub set in the main spin-drying time setting step (S13) can be corrected to decrease in proportion to the obtained value. In addition, a shortened time (ts2) is given by setting a section for a value obtained by subtracting the rotation speed (Wt) of the inner tub 4 measured in the main spin-drying drainage speed measuring step (S32) from the third reference speed (Wr3), and this can be subtracted from the rotation time (T) of the inner tub set in the main spin-drying time setting step (S13) (T2=T−ts2).

In some implementations, when the rotation speed (Wt) of the inner tub 4 measured in the main spin-drying drainage speed measuring step (S32) is less than or equal to the second reference speed (Wr2) and greater than or equal to the third reference speed (Wr3) (Wr3≤Wt≤Wr2), the rotation time (T2=T) of the inner tub set in the main spin-drying time setting step (S13) can be maintained.

In some implementations, when performing the jet rinsing cycle step (S20), the control unit 8 can control the rotation time (T1) of the inner tub set in the main spin-drying time correcting step (S23) based on the rotation speed (Wt) of the inner tub 4 measured in the main spin-drying drainage speed measuring step (S32), in the main spin-drying time adjusting step (S33).

Therefore, when the rotation speed (Wt) of the inner tub 4 measured in the main spin-drying drainage speed measuring step (S32) exceeds the preset second reference speed (Wr2) (Wt>Wr2), the control unit 8 can extend the rotation time (T1) of the inner tub set in the main spin-drying time correcting step (S23) (T2>T1).

Accordingly, when the rotation speed (Wt) of the inner tub 4 measured in the main spin-drying drainage speed measuring step (S32) is less than the preset third reference speed (Wr3) (Wt<Wr3), the control unit 8 can shorten the rotation time (T1) of the inner tub measured in the main spin-drying time correcting step (S23) (T2<T1).

In some implementations, when the rotation speed (Wt) of the inner tub 4 measured in the main spin-drying drainage speed measuring step (S32) is less than or equal to the second reference speed (W2) and greater than or equal to the third reference speed (W3) (W3≤Wt≤W2), the rotation time of the inner tub set in the main spin-drying time correcting step (S23) can be maintained (T2=T1).

Figure 9:
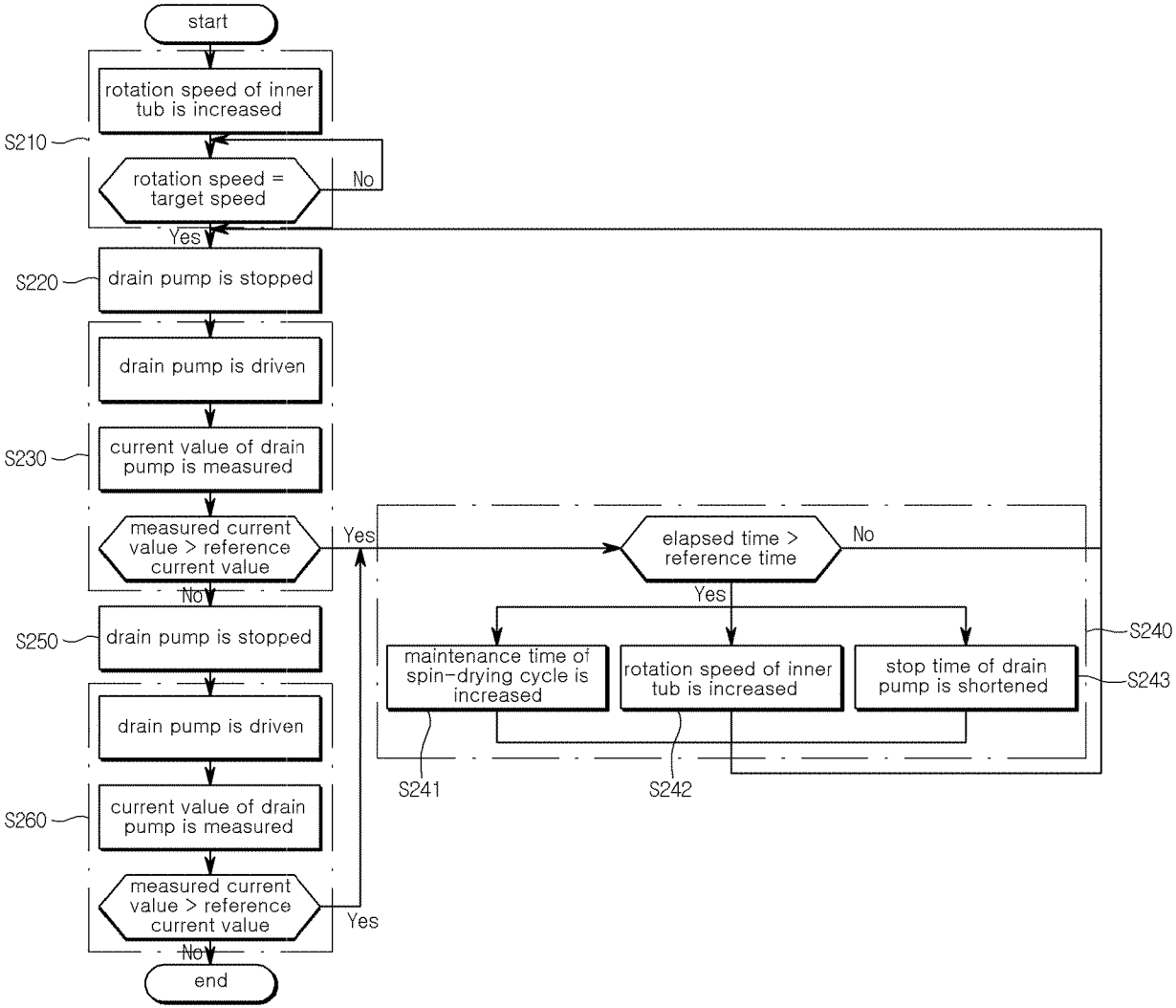
FIG. 9 is a flowchart illustrating another exemplary method for a spin-drying cycle of a washing machine.
Figure 10:
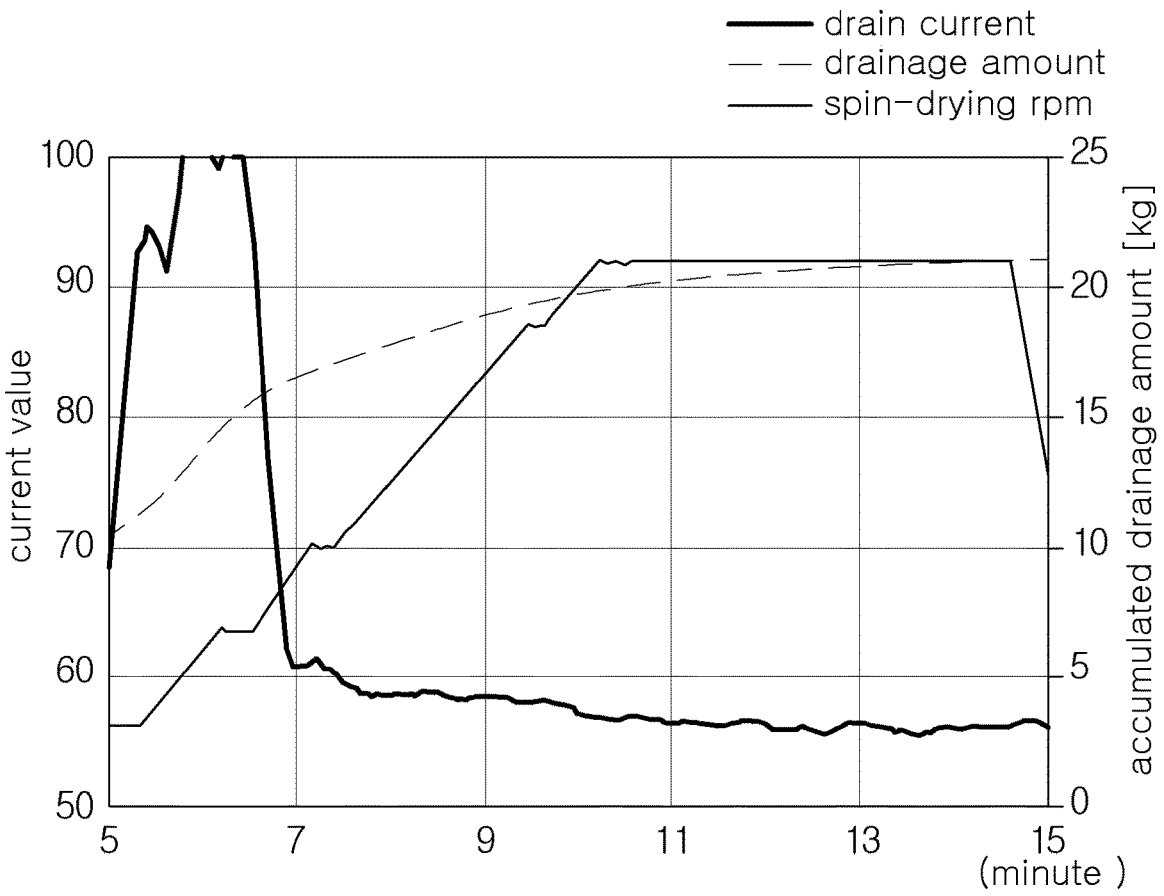
FIG. 10 is a graph illustrating a current value and a drainage amount of a drain pump according to a rotation of an inner tub in another exemplary washing machine.

FIG. 9 is a flowchart illustrating another exemplary spin-drying control method of a washing machine, and FIG. 10 is a graph illustrating a current value and drainage amount of a drain pump according to a rotation of an inner tub in another exemplary washing machine.

Another exemplary spin-drying control method of a washing machine will be described with reference to FIGS. 9 and 10.

In some implementations, a target speed (W1), a reference current (Ir), and a reference time (Tr) can be set in the control unit 8. For example, the target speed (W1) can be set to 800 rpm or more and 900 rpm or less, the reference current (Ir) can be set to 65 mA or more and 75 mA or less, and the reference time (Tr) can be set to 1 minute and 30 seconds or more and 2 minutes or less, but is not limited thereto, and can be changed according to the capacity of the washing machine.

The another exemplary spin-drying control method of the washing machine can include a stop time setting step (S205$_{[JWS1]}$), a spin-drying starting step (S210), a drain stopping step (S220), a drainage amount determining step (S230), a spin-drying time adjusting step (S240), a re-stopping step (S250), and a spin-drying termination determining step (S260).

In some implementations, the stop time setting step (S205) can be performed during the sub spin-drying cycle. The spin-drying starting step (S210), the drain stopping step (S220), the drainage amount determining step (S230), the spin-drying time adjusting step (S240), the re-stopping step (S250), and the spin-drying termination determining step (S260) can be performed during the main spin-drying cycle.

The sub spin-drying cycle can refer to a cycle in which moisture is removed from the laundry after all the water used in the rinsing cycle is drained, and the inner tub 4 is rotated with the decreased rotation speed relatively compared to a rotation speed in the main spin-drying cycle in order to alleviate wrinkling of the laundry.

In the stop time setting step (S205), the control unit 8 can rotate the motor 6 to increase the rotation speed (W) of the inner tub 4 to a preset sub spin-drying target speed while removing the moisture in the laundry, and can measure the current (I) of the drain pump 23 to determine the drainage amount. For example, the control unit 8 can measure a change in the current (I) of the drain pump 23 while increasing the rotation speed (W) of the inner tub 4 to 450 rpm.

When the rotation speed (W) of the inner tub 4 is gradually increased, the moisture of laundry may be discharged to the outer tub 3 through the through hole defined in the inner tub 4 by centrifugal force. After the water in the outer tub 3 flows into the drain pipe 21, the water may be discharged to the outside by the operation of the drain pump 23. In some implementations, when the drain pump 23 operates, the current (I) required for the operation increases in proportion to the increase in the drainage amount. Therefore, the control unit 8 can measure the current (I) of the drain pump 23 to determine the drainage amount during the sub spin-drying cycle.

In some implementations, the control unit 8 can measure the rotation speed (Wt) of the inner tub 4 when the current (I) of the drain pump 23 increases and then decreases to or below a preset sensing current (Is) (I≤Is).

When the rotation speed (W) of the inner tub 4 gradually increases in the sub spin-drying cycle, the current (I) of the drain pump 23 rapidly increases and then decreases to maintain a predetermined current range. In some implementations, maintaining the predetermined current range can refer that sufficient drainage has already been made.

Accordingly, it can be seen that the point in time when the current (I) of the drain pump 23 increases and then decreases to or below the sensing current (Is) (I≤Is) is the point in time when sufficient drainage is achieved.

Then, by measuring the rotation speed (Wt) of the inner tub 4 at a time when the current (I) of the drain pump 23 is decreased to or below the detection current (Is) (I≤Is), the moisture content of the laundry can be predicted.

Thus, as the measured rotation speed (Wt) of the inner tub 4 increases, sufficient drainage is possible only when the high rotation speed is reached, which means that the laundry contains a lot of moisture.

Therefore, in the stop time setting step (S205), the control unit 8 determines the moisture content of the laundry based on the rotation speed (Wt) of the inner tub 4 when the current (I) of the drain pump increases and then decreases to or below the detection current (Is) (I≤Is), and can set the stop time (Tp) of the drain pump in the drain stopping step (S220) in proportion to the moisture content.

In some implementations, the control unit 8 can set the spin-drying time (Ts) in proportion to the moisture content.

In the spin-drying starting step (S210), the control unit 8 can drive the motor 6 to rotate the inner tub 4, and can drive the drain pump 23. Therefore, the control unit 8 can start the main spin-drying cycle.

Then, the control unit 8 can control the washing machine to dehydrate the laundry while increasing the rotation speed (W) of the inner tub 4 to the preset target speed (W1). In some implementations, the current (I) of the drain pump 23 rapidly increases and then starts to decrease (see FIG. 4).

When the rotation speed (W) of the inner tub 4 reaches a preset target speed (W=W1) in the spin-drying starting step (S210), the drain stopping step (S220) can be started.

In some implementations, after the rotation speed (W) of the inner tub 4 reaches the target speed (W1), the control unit 8 can maintain the rotation speed of the inner tub 4 (W=W1) until the spin-drying cycle is terminated. However, the control unit 8 may increase the rotation speed (W) of the inner tub 4 (W>W1) through the spin-drying time adjusting step (S40), which will be described later.

In the drain stopping step (S220), the control unit 8 can stop the drain pump 23 for the preset stop time (Tp).

In some implementations, the stop time (Tp) may be set based on the moisture content of the laundry in the stop time setting step (S205).

In some implementations, the control unit 8 can detect the weight of laundry and set the stop time (Tp) to be longer as the laundry amount is larger (heavier) based on the laundry amount.

In some implementations, the stop time (Tp) is set to 10 seconds or less, but is not limited thereto, and may be changed according to the capacity of the washing machine 100 and the capacity and performance of the drain pump.

The drainage amount determining step S230 can be performed after the stop time (Tp) of the drain stopping step (S220) has elapsed.

In the drainage amount determining step (S230), the control unit 8 can drive the drain pump 23 stopped in the drain stopping step (S220) again for a predetermined time, and then can measure the current value (I) of the drain pump 23. For example, the control unit 8 can measure the current value (I) of the drain pump 23 after the drain pump 23 is driven again for 30 seconds, but is not limited thereto, and it can be changed according to the capacity of the washing machine 100 and the capacity and performance of the drain pump.

In the drainage amount determining step (S230), the control unit 8 can determine whether the current value (I) of the drain pump 23 exceeds the preset reference current value (Ir).

In the spin-drying time adjusting step (S240), the control unit 8 can change the spin-drying time by comparing the time (T) elapsed since the inner tub 4 starts to rotate with a preset reference time (Tr) when the current value (I) of the drain pump 23 measured in the drainage amount determining step (S230) exceeds the reference current value (Ir) (I>Ir).

In some implementations, the time (T) elapsed after the inner tub 4 starts to rotate may refer to the interval from the point in time when the inner tub 4 starts to rotate in the spin-drying starting step (S210) to the point in time when the current value (I) of the drain pump 23 is measured in the drainage amount determining step (S230).

In the spin-drying time adjusting step (S240), the control unit 8 can increase the preset spin-drying time (Ts) by a predetermined time (t1) (Ts1=Ts+t1) when the time (T) elapsed since the inner tub (4) starts to rotate exceeds the reference time (Tr) (T>Tr) (S241).

In some implementations, the spin-drying time (Ts) may mean from a point in time when the inner tub 4 starts to rotate in the spin-drying starting step (S210) to a point in time when the inner tub 4 stops to rotate and the spin-drying cycle is terminated.

In addition, increasing the spin-drying time may mean delaying a point in time when the inner tub 4 stops to rotation at the preset spin-drying time by a predetermined time (t1).

In the spin-drying time adjusting step (S240), the control unit 8 can increase the rotation speed (W) of the inner tub 4 (W>W1) when the time (T) elapsed since the inner tub 4 starts to rotate exceeds the reference time (Tr) (T>Tr) (S242).

In the spin-drying time adjusting step (S240), the control unit 8 can shorten the stop time (Tp) for stopping the driving of the drain pump 23 by a predetermined time (t2) (Tp1=Tp−t2) when the time (T) elapsed since the inner tub 4 starts to rotate exceeds the reference time (Tr) (T>Tr). For example, when the preset stop time (Tp) is 9 seconds, it can be shortened to 8 seconds (Tp1<Tp) (S243).

In some implementations, in the spin-drying time adjusting step (S240), the control unit 8 can selectively perform the increase of the spin-drying time (Ts) (S241), the increase of the rotation speed of the inner tub 4 (S242), or the shortening (S243) of the stop time (Tp), and the control unit 8 can perform by combining any two of them, or may perform all of them.

Therefore, in some implementations, the stop time (Tp) of the drain pump 23 can be set based on the moisture content in the laundry or the amount of laundry, and the current value (I) of the drain pump 23 can be measured during the spin-drying cycle to determine the moisture drainage ability of the laundry, and correspondingly, a constant degree of dehydration can be provided by resetting the spin-drying cycle time (Ts) and the rotation speed (W) of the inner tub 4.

After the spin-drying time adjusting step (S240), the control unit 8 can perform the drain stopping step (S220).

In some implementations, in the spin-drying time adjusting step (S240), the control unit 8 can perform the drain stopping step (S220) when the time (T) elapsed since the inner tub 4 starts to rotate is less than or equal to the reference time (Tr) (T≤Tr).

In some implementations, when the current value (I) of the drain pump 23 measured in the drainage amount determining step (S230) is less than or equal to the reference current value (Ir) (I≤Ir), the control unit 8 can control the re-stopping step (S250).

In the re-stopping step (S250), the control unit 8 can stop the operation of the drain pump 23 for the stop time (Tp).

In some implementations, when the stop time (Tp) is shortened (Tp1) in the spin-drying time adjusting step (S240) and then the re-stopping step (S250) is started, the originally input stop time (Tp) can be restored, and then the driving of the drain pump 23 can be stopped.

In some implementations, when the stop time (Tp) is shortened (Tp1=Tp−t2) in the spin-drying time adjusting step (S240) and then the re-stopping step (S250) is started, the driving of the drain pump 23 can be stopped with the shortened stop time (Tp1=Tp−t2).

In some implementations, in the re-stopping step (S250), the control unit 8 can stop the driving of the drain pump 23, but may shorten the previously input stop time (Tp) by a predetermined time (t3) (Tp−t3).

The spin-drying termination determining step (S260) can be performed after the stop time of the re-stopping step (S250) has elapsed.

In the spin-drying termination determining step S260, the control unit 8 can measure the current value (I) of the drain pump 23 again after driving the drain pump 23 again for a predetermined time. Then, by comparing the remeasured current value (I) of the drain pump 23 with the reference current value (Ir), the control unit can determine whether to terminate the spin-drying cycle.

In the spin-drying termination determining step (S260), the control unit 8 can perform the spin-drying time adjusting step (S240) when the remeasured current value (I) of the drain pump 23 exceeds the reference current value (Ir) (I>Ir).

In the spin-drying termination determining step (S260), the control unit 8 can terminate the spin-drying cycle when the remeasured current value (I) of the drain pump is less than or equal to the reference current value (I≤Ir).

The invention claimed is:

1. A washing machine comprising:

an outer tub configured to receive water;

an inner tub rotatably disposed with respect to a vertical axis of the outer tub, defining an opening at a lower portion, and in fluid communication with the outer tub;

a drain pump configured to be driven by an electric current to thereby drain the water from the outer tub;

a motor configured to provide a rotational force to the inner tub; and a control unit including a processor and configured to control the drain pump and the motor to perform a spin-drying cycle including a sub spin-drying cycle and a main spin-drying cycle, wherein the control unit is configured to:

rotate the motor to increase a rotation speed of the inner tub to a preset first target speed during the sub spin-drying cycle to remove moisture from laundry received in the inner tub, measure the current of the drain pump to measure an amount of water dehydrated from the laundry while the inner tub is rotated, measure, based on the current of the drain pump being increased and then decreased to or below a preset reference current, the rotation speed of the inner tub, and change a preset rotation time of the inner tub in the main spin-drying cycle according to the measured rotation speed of the inner tub.

2. The washing machine according to claim 1, wherein the control unit is configured to, based on the current of the drain pump exceeding the reference current in a state in which the rotation speed of the inner tub is increased to the first target speed, increase the preset rotation time of the inner tub in the main spin-drying cycle during the sub spin-drying cycle.

3. The washing machine according to claim 1, wherein the control unit is configured to, based on the measured rotation speed of the inner tub being less than a preset first reference speed, shorten the preset rotation time of the inner tub in the main spin-drying cycle during the sub spin-drying cycle.

4. The washing machine according to claim 1, wherein the control unit is configured to, based on the measured rotation speed of the inner tub being less than a preset first reference speed, decrease the rotation speed of the inner tub in the main spin-drying cycle during the sub spin-drying cycle.

5. The washing machine according to claim 1, wherein, during the main spin-drying cycle, the control unit is configured to:

rotate the motor to increase the rotation speed of the inner tub to a second target speed, measure the current of the drain pump while the inner tub is rotated at the second target speed, measure, based on the current of the drain pump being increased and then decreased to or below the reference current, the rotation speed of the inner tub, and extend, based on the measured rotation speed of the inner tub exceeding a preset second reference speed, the changed rotation time of the inner tub in the main spin-drying cycle.

6. The washing machine according to claim 1, wherein, during the main spin-drying cycle, the control unit is configured to:

rotate the motor to increase the rotation speed of the inner tub to a second target speed, measure the current of the drain pump while the inner tub is rotated at the second target speed, measure, based on the current of the drain pump being increased and then decreased to or below the reference current, the rotation speed of the inner tub, and shorten, based on the measured rotation speed of the inner tub being less than a preset third reference speed, the changed rotation time of the inner tub in the main spin-drying cycle.

7. The washing machine according to claim 1, wherein the inner tub includes a nozzle configured to spray water by centrifugal force during rotation of the inner tub, and wherein the control unit is configured to perform a jet rinsing cycle in which the water is sprayed onto the laundry through the nozzle while the inner tub is rotated at a predetermined speed between the sub spin-drying cycle and the main spin-drying cycle.

8. The washing machine according to claim 7, wherein the control unit is configured to:

measure the current of the drain pump during the jet rinsing cycle, measure a jet rinsing drainage time from the jet rinsing cycle is started to the current of the drain pump is increased to or above the reference current, and extend, based on the jet rinsing drainage time exceeding a preset first reference time, the changed rotation time of the inner tub in the main spin-drying cycle.

9. The washing machine according to claim 7, wherein the control unit is configured to:

measure the current of the drain pump during the jet rinsing cycle, measure a jet rinsing drainage time from the jet rinsing cycle is started to the current of the drain pump is increased to or above the reference current, and shorten, based on the jet rinsing drainage time being less than a preset second reference time, the changed rotation time of the inner tub in the main spin-drying cycle.

10. A method for controlling a spin-drying of a washing machine including a sub spin-drying cycle and a main spin-drying cycle, the method comprising:

a sub spin-drying drainage amount measuring step, performed in the sub spin-drying cycle, including removing water from laundry while increasing a rotation speed of an inner tub of the washing machine to a preset first target speed, and determining a drainage amount by measuring a current of a drain pump that discharges moisture dehydrated from the laundry;

a sub spin-drying drainage speed measuring step including measuring, based on the current of the drain pump being increased and then decreased to or below a preset reference current, the rotation speed of the inner tub; and a main spin-drying time setting step including setting a rotation time of the inner tub in the main spin-drying cycle based on the measured rotation speed of the inner tub.

11. The method for controlling a spin-drying of a washing machine according to claim 10, further comprising:

a main spin-drying drainage amount measuring step, performed in the main spin-drying cycle, including measuring the current of the drain pump while increasing the rotation speed of the inner tub to a preset second target speed;

a main spin-drying drainage speed measuring step including measuring, based on the current of the drain pump being increased and then decreased to or below the reference current, the rotation speed of the inner tub; and a main spin-drying time adjusting step including adjusting a rotation time of the inner tub set in the main spin-drying time setting step based on the measured rotation speed of the inner tub.

12. The method for controlling a spin-drying of a washing machine according to claim 10, further comprising a jet rinsing cycle step including spraying water to the laundry while rotating the inner tub at a predetermined rotation speed after the sub spin-drying cycle.

13. The method for controlling a spin-drying of a washing machine according to claim 12, wherein the jet rinsing cycle step includes:

a jet rinsing drainage amount measuring step including spraying the water to the laundry while rotating the inner tub at the predetermined rotation speed, and measuring the current of the drain pump;

a jet rinsing drainage time measuring step including measuring a time from the spray of water is started to the current of the drain pump is increased to or above the reference current; and a main spin-drying time correcting step including correcting the rotation time of the inner tub set in the main spin-drying time setting step based on the time measured in the jet rinsing drainage time measuring step.

* * * * *